US005451975A

United States Patent [19]

Miller et al.

[11] Patent Number: 5,451,975

[45] Date of Patent: Sep. 19, 1995

[54] FURLABLE SOLID SURFACE REFLECTOR

[75] Inventors: Ellsworth B. Miller, Alamogordo, N. Mex.; Robert C. Nyden, Alameda, Calif.

[73] Assignee: Space Systems/Loral, Inc., Palo Alto, Calif.

[21] Appl. No.: 18,106

[22] Filed: Feb. 17, 1993

[51] Int. Cl.[6] ..... H01Q 15/16

[52] U.S. Cl. ..... 343/915; 343/840

[58] Field of Search ..... 343/915, 840, 912, 916; H01Q 15/20, 15/16

[56] References Cited

U.S. PATENT DOCUMENTS

| | | | |
|---|---|---|---|
| 3,576,566 | 4/1971 | Cover, Jr. | 343/705 |
| 3,631,505 | 12/1971 | Carman et al. | 343/915 |
| 3,715,760 | 2/1973 | Palmer | 343/915 |

OTHER PUBLICATIONS

Patent Abstracts of Japan, vol. 10, No. 16 (E-375) (2073) 22 Jan., 1986, JP-A-60 178 706 (Mitsubishi).

Patent Abstracts of Japan, vol. 10, No. 213 (E-422) (2269) 25 Jul., 1986, JP-A-61 052 008 (Asahi Chem. Ind.).

*Primary Examiner*—Michael C. Wimer

*Attorney, Agent, or Firm*—Perman & Green

[57] ABSTRACT

A large, deployable reflector (10) having several long, tapered petals (20) hinged at the tapered end to a top ring. The top ring (22) is attached to a central disk (26) positioned below the top ring (22) such that it is contained within the petals (20) when they are in the closed position. The center disk (26) is attached to the top ring (22) by several screw jacks (28) such that the center disk (26) moves up to a position proximate the 10 top ring (22) as the petals (20) are moved outward from the closed position to the open position. In the deployed position, the reflector surface forms a substantially solid, parabolic surface. Telescoping struts (40) are attached to the underside of selected ones of the petals (20) to enable steering of the reflector (10). The struts (40) are positioned such that the central axis of the paraboloid formed by the deployed reflector (10) remains clear.

17 Claims, 8 Drawing Sheets

FURLABLE SOLID SURFACE REFLECTOR

FIELD OF THE INVENTION

The invention generally relates to deployable satellite reflectors of the type launched and sustained in space, typically about Earth's orbit or for deep space probe applications. Specifically, the invention relates to large, solid surface reflectors for reflecting electromagnetic signals.

BACKGROUND OF THE INVENTION

High-gain antenna reflectors have been deployed into space for several decades. The configurations of such reflectors have varied widely as material science developed and as the sophistication of technology and scientific needs increased.

Large diameter antenna reflectors pose particular problems both during deployment and post-deployment. Doubly-curved, rigid surfaces which are sturdy when in a deployed position cannot be folded for storage. Often, reflectors are stored one to two years in a folded, stored position prior to deployment. In an attempt to meet this imposed combination of parameters, large reflectors have been segmented into petals so that these petals could be stowed in various overlapped configurations. However, the structure required in deploying such petals has tended to be rather complex and massive, thus reducing the feasibility of such structures. For this reason, parabolic antennae reflecting surfaces larger than those that can be designed with petals typically employ some form of a compliant structure.

Responsive to the need for such a compliant structure, rib and mesh designs have been built, tested, and used. However, such antennae tend to suffer from chording in both radial and circumferential directions. The use of mesh in such a configuration has an inherent disadvantage in diminishing the reflective quality of the resulting parabolic surface. Further, a mesh cannot be made to assume a truly parabolic configuration.

Other antennae designs typically include a center post about which the petals are configured, much like an umbrella configuration. This also affects the reflective quality of the resulting surface, since the center portion typically is the point of optimum reflectance, which is then blocked by the center post. Thus, it is desirable to have a structure that is deployable from a compact, stored position to a parabolic, open position without the use of a center post.

More recently, antenna reflectors have been constructed from carbon fiber reinforced, synthetic material (CFK). Such material may satisfy the requirements for space technology and contour accuracy and, therefore, high performance antenna systems. However, power and performance of such antennae are limited, owing to the size of the payload space in a carrier space vehicle. Very large completely rigid antennas are highly impractical to launch into space, hence the requirements for practical purposes can be satisfied only when the antenna is of a collapsible and foldable construction.

At present, antenna reflectors of the collapsible and foldable variety are of two design types. One type is a grid or mesh type reflector that is folded like an umbrella. The other type includes foldable rigid and hinged petals. Antennas of this second type are available in a variety of configurations, some of which are disadvantaged by the requirement for an excessive number of joints and segment pieces which, owing to the particular folding and collapsing construction, are of different shape and size. Also, the larger the number of hinges and segments, the more complex will be the deployment mechanism and its operation.

Available mesh cloth-covered parabolic rib reflectors form a poor approximation to the ideal smooth, solid paraboloid surface, since the mesh cloth typically is stretched taut circumferentially between each pair of adjacent parabolic shaped ribs. The resulting mesh shape is a triangular gore curved in the radial direction but flat in the circumferential direction. That is, each mesh gore is a singly curved approximation to the desired ideal doubly curved paraboloid gore. For a given paraboloid reflector diameter, the number of ribs used determines the width of each mesh singly-curved gore. Thus, more ribs result in more and narrower mesh gores, with each narrower gore being a better approximation of the ideal paraboloid shaped gore. However, more ribs used for a given reflector diameter results in more mass for the reflector. The resulting mesh cloth-/rib reflector concept contains an inherent trade-off of increasing weight versus closeness of the surface shape approximation to the desired true paraboloid shape. Thus, for higher RF frequency usage, the mesh cloth-/rib reflector concept requires an increasing number of ribs for a given aperture efficiency requirement.

Thus, there remains a need for a deployable antenna reflector that provides a solid reflector surface upon deployment and that retains its parabolic shape during extended storage.

SUMMARY OF THE INVENTION

The present invention is a large deployable reflector (10) of several long, tapered petals (20) hinged at the tapered end to a top ring (22). The top ring (22) is attached to a central disk (26) positioned below the top ring (22) such that it is contained within the petals (20) when they are in the closed position. The center disk (26) is attached to the top ring (22) by several screw jacks (28) such that the center disk (26) moves up to a position proximate the top ring (22) as the petals (20) are moved outward from the closed position to the open position.

Several adjustable struts (40) are attached to the underside of a few of the petals (20). The struts (40) are attached to an activating device (42) for selectively telescoping the struts (40) either prior to or after deployment of the petals (20) in the open position. The strut elements (40) further act as support elements for the petal structure in the open, deployed position, and are angled away from the central axis of the paraboloid formed by the petals (20).

The activating devices (42) attached to the struts (40) preferably permit selective activation of each strut (40) independent of each other. The activating device (42) preferably is a linear actuator. Activating devices (44) also are attached to the screw jacks (28) to move the center disk (26) toward the top ring (22) during deployment of the reflector (10).

The petals (20) preferably are constructed of a flexible, shape-memory material such as a high-modulus graphite material and resin system with shape-memory. Each petal (20) includes an elongate rib element (30) that extends at least partially along the length of the petal (20) to provide structural support. The rib elements (30) preferably are constructed of a rigid material.

To deploy the inventive apparatus in accordance with the present inventive method, the strut elements (40) are telescoped out to an extended position. This moves the reflector structure with the petals (20), still in their closed position, away from the attached support structure (52). Next, the center disk (26) is moved into position proximate the top ring (22), as the petals (20) are moved outward from the top ring (22) element into a paraboloid shape. Once in position, the reflector (10) may spatially be positioned by selectively telescoping and contracting .selected ones of the struts (40). By thus angling the reflector (10) by approximately 5 degrees about the central axis, it is possible to tilt the reflector (10) to steer the R.F. beam direction a full 360 degrees in space.

BRIEF DESCRIPTION OF THE FIGURES

FIG. 4 is a cross-sectional view of the embodiment of FIG. 1 in a fully deployed position.

FIGS. 4A and 4B are collectively referred to as FIG. 4.

DETAILED DESCRIPTION OF THE PREFERRED EMBODIMENTS

The present invention is a large, deployable fanfold reflector apparatus 10 having a paraboloid shape upon deployment in space, and a method for deploying the apparatus. The reflector 10 includes many elongate, tapered members 20 hinged to a central section.

Figure 1:
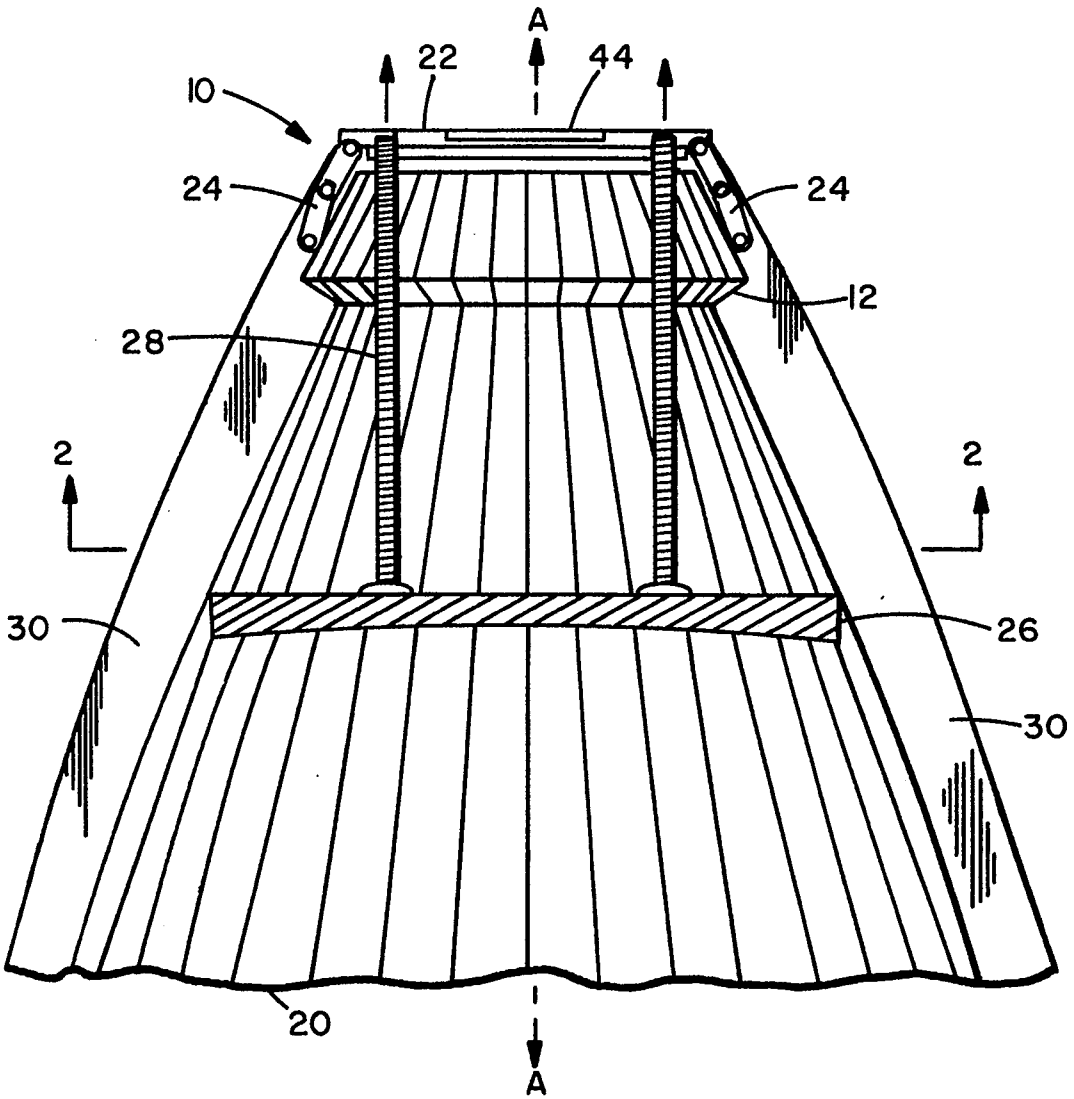
FIG. 1 is a cross-sectional view of an embodiment of the present inventive reflector (10) in a closed, stored position.

Turning to FIG. 1, the reflector 10 is shown in a closed, stored position. The reflector 10 consists of several tapered elongate members (petals) 20, attached at the tapered end to a top ring 22 by hinge elements 24. The ring 22 is attached to a center disk 26 by one or more attachment elements 28, such as screw jacks. As the petals 20 are moved to the deployed position, radiating outward from the top ring 22, the center disk 26 is moved upward along the central axis A—A to a position proximate the top ring 22.

In a preferred form of the invention, the underside of each elongate member 20 includes a notch 12 for locking the center disk 26 in a final deployed position. By locking the petals 20 with the center disk 26 in the petal notches 12, a smooth surface is formed and retained after deployment. The center disk 26 preferably is a parabolic shape, with the concave surface facing away from the top ring 22. In this manner, the center disk 26 can function as a reflecting surface, since it is centrally located in the parabola formed by the petals 20 in the final, deployed position.

The petals 20 preferably are constructed of a material that is both flexible enough to permit long-term storage of the petals 20 in a closed position, yet rigid enough to retain a paraboloid shape in a deployed position. Thus, each curved petal 20 is made of a thin and advanced composite fiber material that nominally is stiff but somewhat flexible in the circumferential direction, thus allowing the furled petals 20 to curve and slide over each other to compress the package into a folded diameter. Typically, the folded diameter is less than 1/5 of the deployed diameter.

The ability of the long, narrow, parabolic petals 20 to flex from the stowed configuration to the deployed shape requires specific materials characteristics. Recently developed carbon fibers and laminating resin systems make this possible without the petals 20 taking on a permanent "set". Very thin 0.001 inch thick per ply material, with ultra high modulus 100 MSI and elongation of greater than 0.5% carbon fibers, when coupled with toughened polycyanate resin systems, are preferred materials systems for use in making the petals 20. Laminates produced from these materials exhibit good spring back, are not prone to microcracking when held in a distorted shape, are very low in moisture absorption (CME), and have tailorable coefficient of expansion (CTE). These systems also exhibit good radiofrequency (RF) reflective characteristics without a metallized surface.

Preferred materials that may be used to manufacture petals 20 of the present invention include high modulus graphite material with a resin system with memory. By high modulus is meant material of from about 80 million psi to about 120 million psi. Exemplary material includes XN70 with an RS-3 resin system (polycyanate resin system), commercially available from YLA, Inc., Benicia, Calif. An important aspect of the preferred material is that it has shape-memory to enable it to retain its original, parabolic shape after long-term, e.g., one to two years, storage in a folded configuration.

The hinge element 24 may be a spherical bearing that permits each petal 20 to rotate about 65° along the vertical axis, to a closed position, and about 3°–13° along the horizontal axis to overlay during the deployed position. In a preferred embodiment, the petals 20 all simultaneously move from the closed to the open position.

In a preferred form of the invention, each petal 20 includes a structural rib element 30 that extends at least partially along the length of the top surface of the petal 20. Preferably, the rib element 30 extends along the entire length of one top side of each petal 20. The rib 30 is formed of a rigid material, such as any rigid filament, of fixed length that functions to maintain the shape integrity of the petal 20 when deployed. Any rigid, light-weight, durable material may be used for manufacturing rib elements 30 consistent with the present invention.

In a preferred form of the invention, the apparatus 10 includes a plurality of petals 20, with a few structural petals 32 interspersed at regular intervals. The structural petals 32, best illustrated in FIG. 2, typically are twice the width of regular petals 20 and include a single rib element 30 extending down the center of the top surface of the petal 32.

Also in a preferred form of the invention, the apparatus 10 includes cover petals 34 interspersed at regular intervals among the other petals 20. The cover petals 34 typically are twice the width of regular petals 20 and include two rib elements 30, one along each side top surface of each petal 34. The interoperation of each of these three types of petals 20, 32, 34, are described below in conjunction with FIG. 2.

Figure 2:
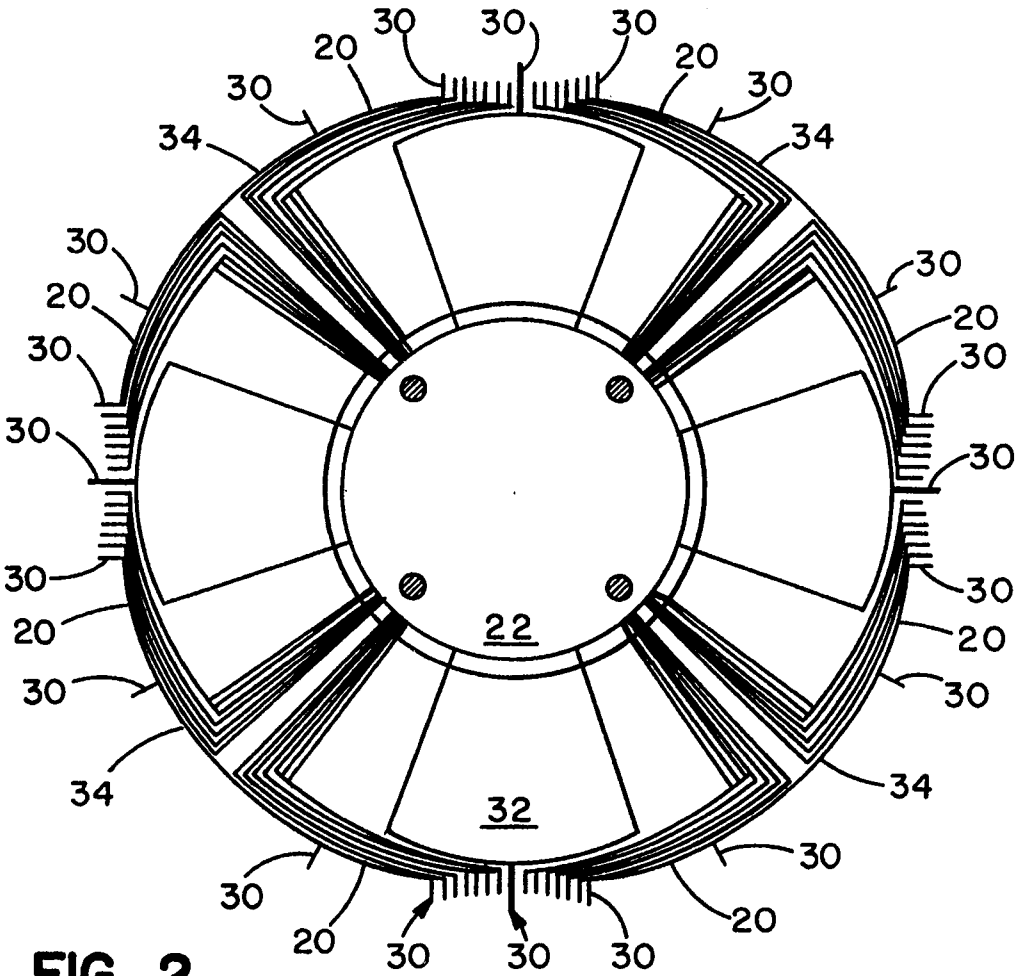
FIG. 2 is a cross-sectional view of the reflector (10) of FIG. 1, taken along the 2—2 axis of FIG. 1.

FIG. 2 shows an embodiment of the present inventive reflector apparatus 10 in a closed, stored position. When stored, the petals 20 overlap each other in a staggered manner and overlap an adjacent structural petal 32. The rib elements 30 associated with each petal 20, 32 are aligned adjacent each other to form a substantially compact arrangement. The cover petals 34 fit over the nonribbed edge of the overlapping petals 20. Altogether, the petals 20, 32, 34 form a compact arrangement radiating from the top ring 22 and enclosing the center disk 26. In the illustrated embodiment, there are essentially four quadrants, each quadrant including one structural petal 32 and one cover petal 34, with a plurality of evenly distributed regular petals 20.

Figure 3:
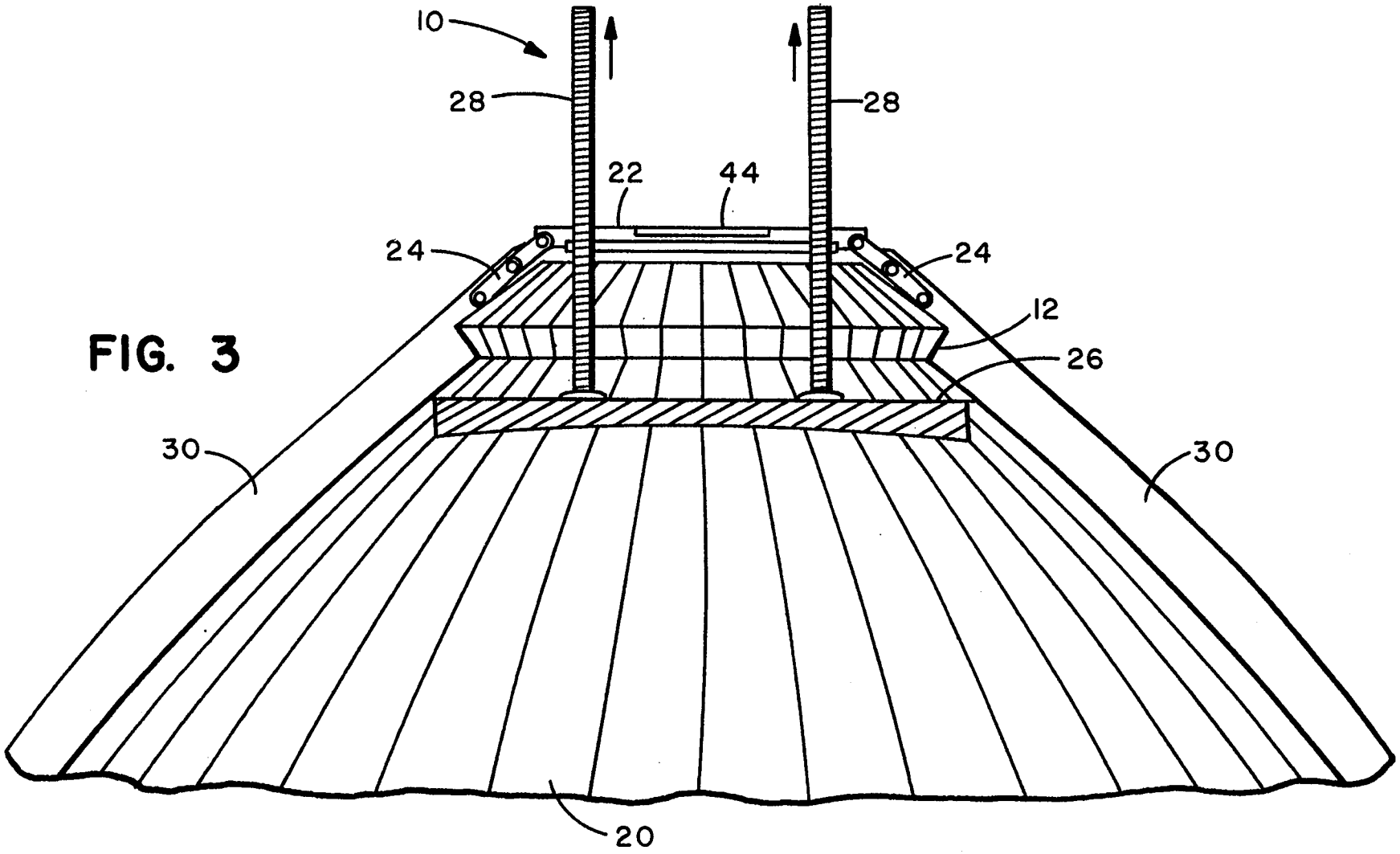
FIG. 3 is a cross-sectional view of the embodiment of FIG. 1 in a partially deployed position.

As the reflector 10 is deployed, the center disk 26 moves upward toward the top ring 22 by means of the attachment elements 28, as shown in FIG. 3. As described in further detail below, the attachment elements 28 are attached to activating means 44, such as a standard electric drive motor. Upon activation of the motor 44, the attachment elements 28 move upward along the central axis A—A, bringing the center disk 26 proximate to the top ring 22.

In an alternate form of the invention, and as shown in FIGS. 6–9, the reflector 10 may include a single attachment element 28, or may include two or more such elements 28. The number of such elements 28 is not material to the operation or structure of the present invention.

Figure 4A:
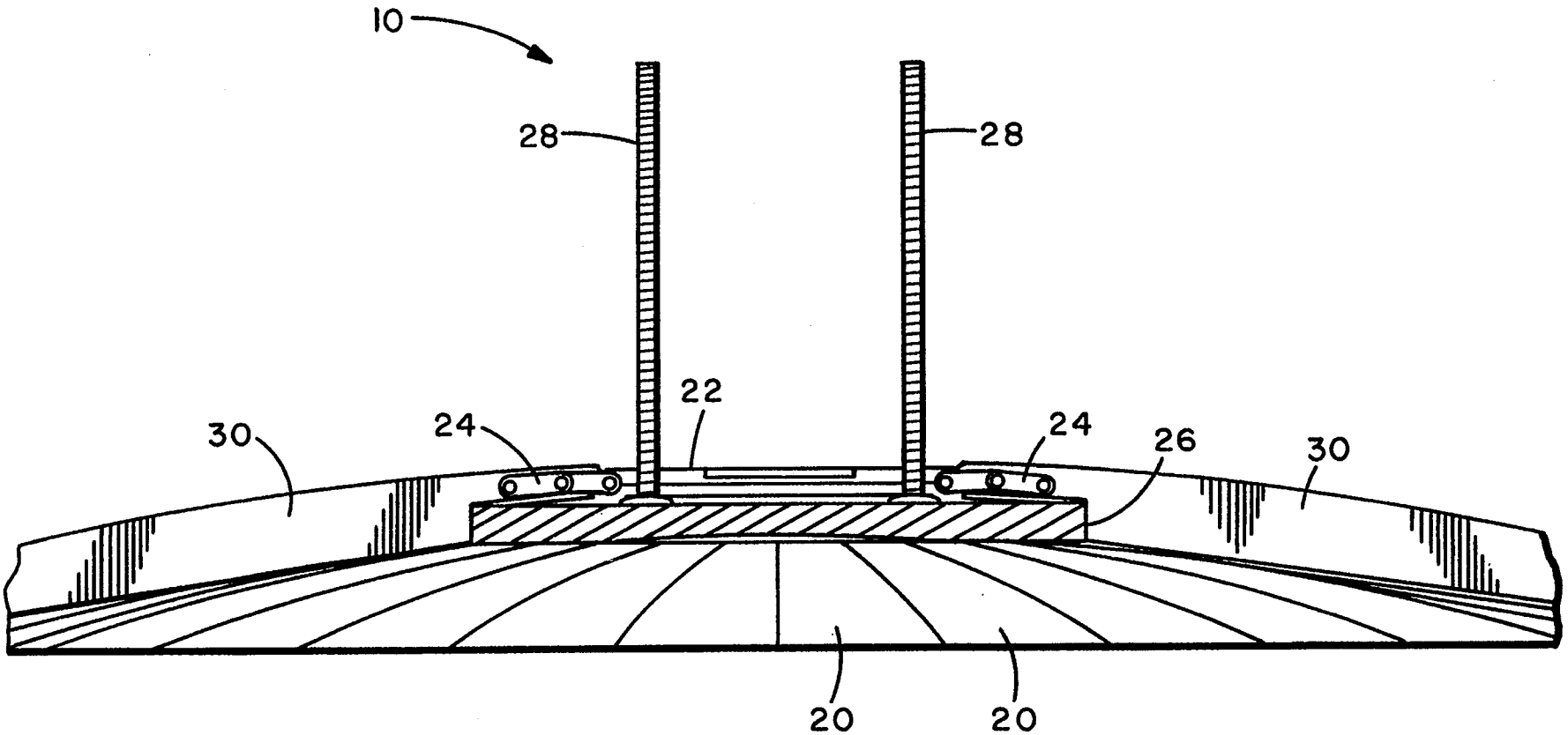
Figure 4B:
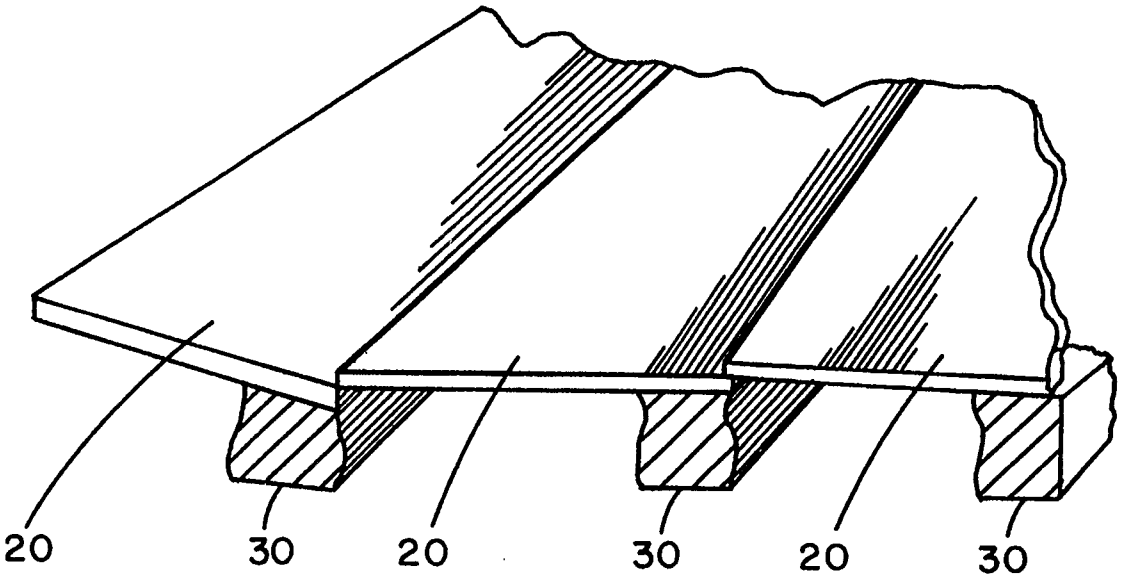
FIG. 4B is an elevational view of a portion of the reflector assembly showing an overlap between petals (20) when the reflector is in a fully deployed position. Hereinafter

FIG. 4 shows an embodiment of the reflector 10 in a fully deployed position. The attachment elements 28 are fully extended, and the top ring 22 is adjacent to the center disk 26, which is locked into position in the notches 12. The extended petals 20 are slightly overlapping each other, and are restrained to the desired final reflector diameter by the notches 12 and a circumferential cable (not shown) on the top outer circumference of the reflector 10.

Figure 5:
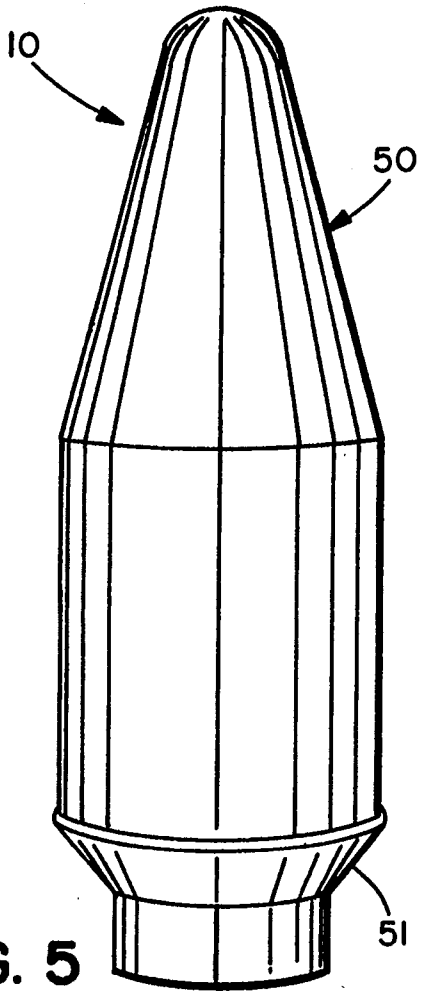
FIG. 5 is a perspective view of a reflector deployment system incorporating an embodiment of the reflector (10) of the present invention in a closed, stored position.
Figure 6:
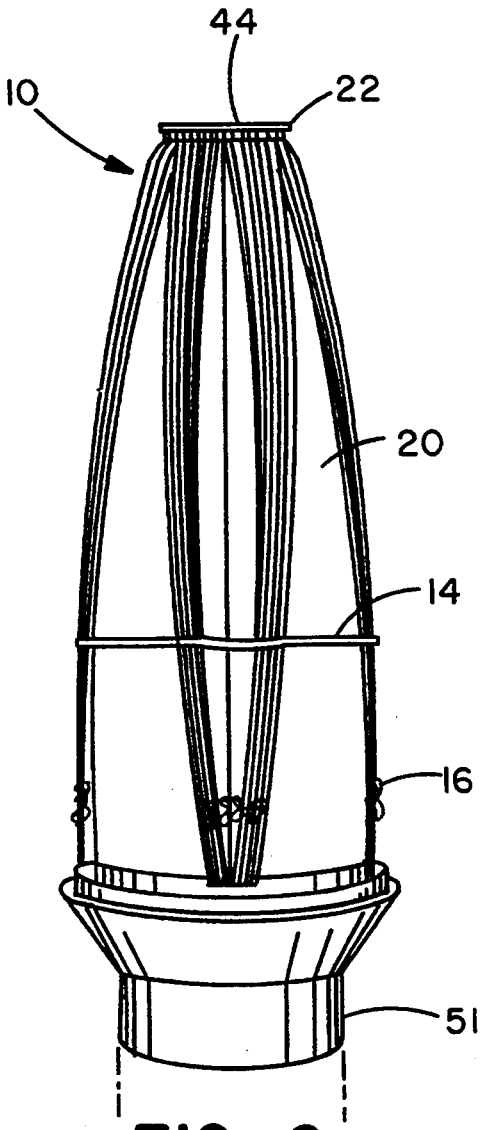
FIG. 6 is a perspective view of an alternative embodiment of the reflector (10) of the present invention in a closed, stored position.

Turning to the method of the present invention, as shown in FIGS. 5–9, FIG. 5 shows a launch vehicle shroud 50 enclosing the folded inventive reflector 10 attached to a launch vehicle 51. In FIG. 6, the shroud 50 has been discarded, revealing the folded, stored reflector 10. In the illustrated embodiment, the reflector consists of sixty-four petals 20, each having a width from approximately 5.5 inches at the tapered end to approximately 36 inches at the wide end, and a length of approximately 25 feet. This is a standard version, but may either be smaller or over 200 feet. When opened in the deployed position, the illustrated reflector 10 has a diameter of about 56 feet. In the stored state, the reflector 10 may be reduced in diameter by about eighty-five percent.

In a preferred form of the invention, and as illustrated in FIG. 6, a selectively releasable element 14, such as a lanyard cable, encircles the petals 20 and secures them in a folded, stored position. The lanyard 14 may be manufactured from an appropriate material depending on size of the structure and external factors such as thermal requirements. The selectively releasable element 14 may be retained around the closed reflector 10 by means of a pyroclamp, or other securing device, which may be released upon receiving a trigger signal. Also shown in a stored state, is a circumferential cable 16 that functions to retain the shape of the reflector 10 in its open, deployed position.

Figure 7:
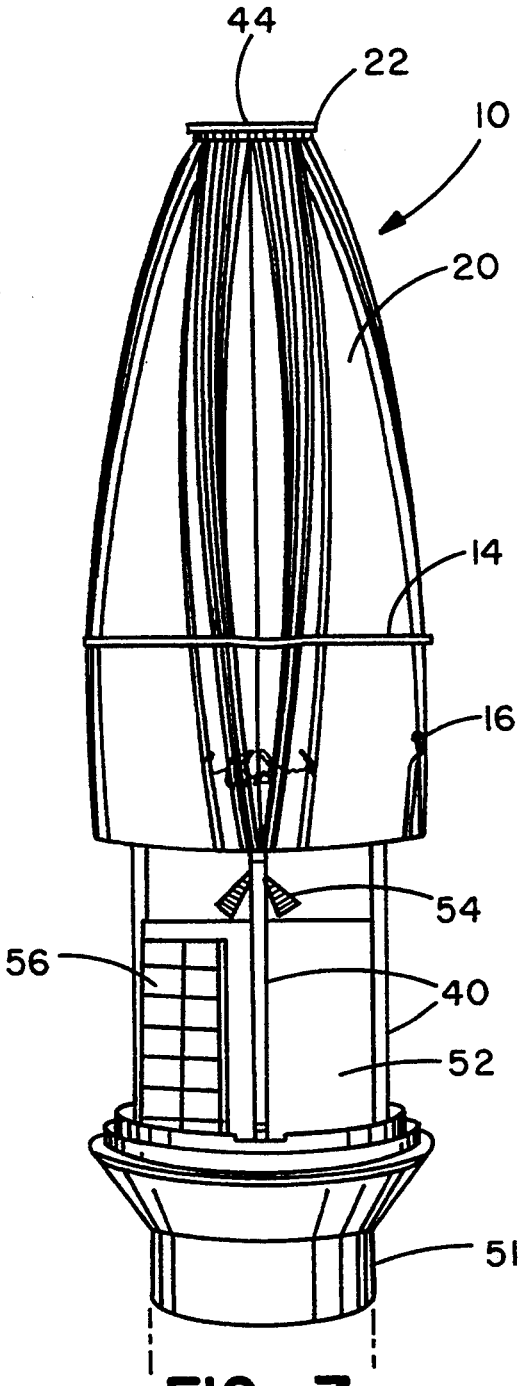
FIG. 7 is a perspective view of the embodiment of FIG. 6 after extension of the strut elements (40).

The inventive reflector apparatus 10 preferably includes a plurality of strut elements 40, as illustrated in FIGS. 7 and 8*a*. The struts 40 are attached, at one end, to a base 52 including an activating device 42 for activating the struts 40 to the extended position of FIG. 7. The base 52 may also include an antenna/feed device 54 positioned at the focal point of the paraboloid formed by the fully deployed petals 20.

At their other ends, the strut elements 40 are attached to the underside of selected, spaced apart petals 20. Preferably, the struts 40 are attached to the underside of the structural petals 32 at a location on the petal directly underneath the position of the rib element 30. In a preferred form of the invention, there are a plurality of strut elements 40 angled away from the central axis A—A of the reflector 10. Thus, an acute angle is defined between the ray extending from the base 52 to the petals 20 along the line of a strut element 40 and the central axis A—A.

Each strut element 40 may be attached to a separate activating device 42, or several of the strut elements 40 may be attached to a single activating device 42 programmable to selectively activate one strut element 40 at a time. The activating device 42 may include a motor, such as an Astro Bi-stem motor having a coiled piece of flat wire for telescoping the attached strut element 40.

In practicing the inventive method, the entire apparatus shown in FIG. 5 is sent into the desired orbital position. Then, the shroud 50 is shed and the struts 40 are extended in a telescoping manner to position the closed petals 20 away from the base 52. By telescoping the struts 40 at least partially away from the base, attitude control jets (not shown) attached to the base 52 may be activated to steer the apparatus 10 during transfer into orbit and for attitude control when in orbit.

Figure 8:
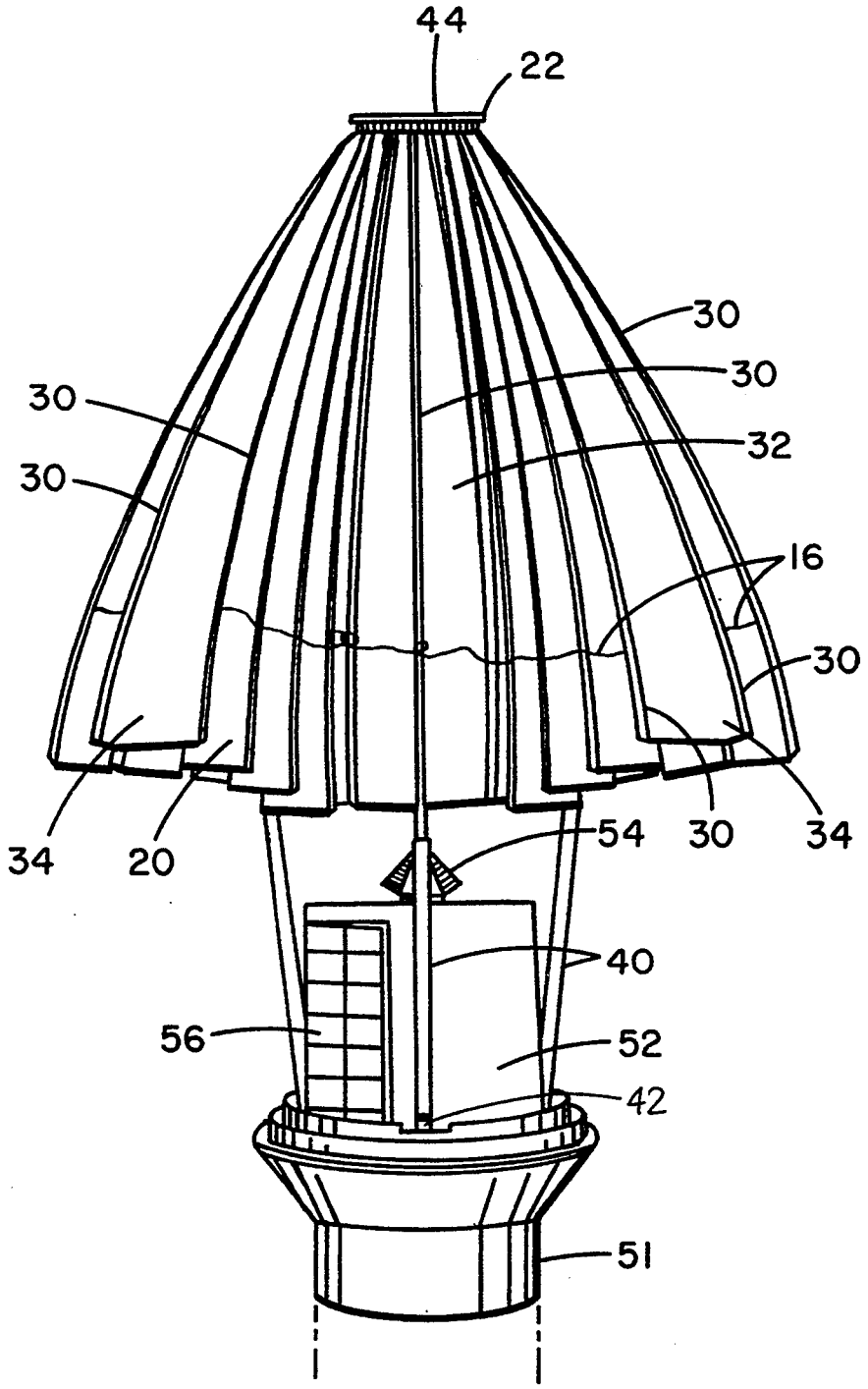
FIG. 8 is a perspective view of the embodiment of FIG. 6 in a partially deployed position, after the lanyard (14) has been removed from around the petals (20).

Once in final orbit, the lanyard cable 14 is released, allowing the petals 20 to open (see FIG. 8). Releasing the lanyard cable 14 allows stored elastic energy of the curved overlapped petals 20 to release and the petals 20 to move outward to a partially deployed first state.

Figure 9:
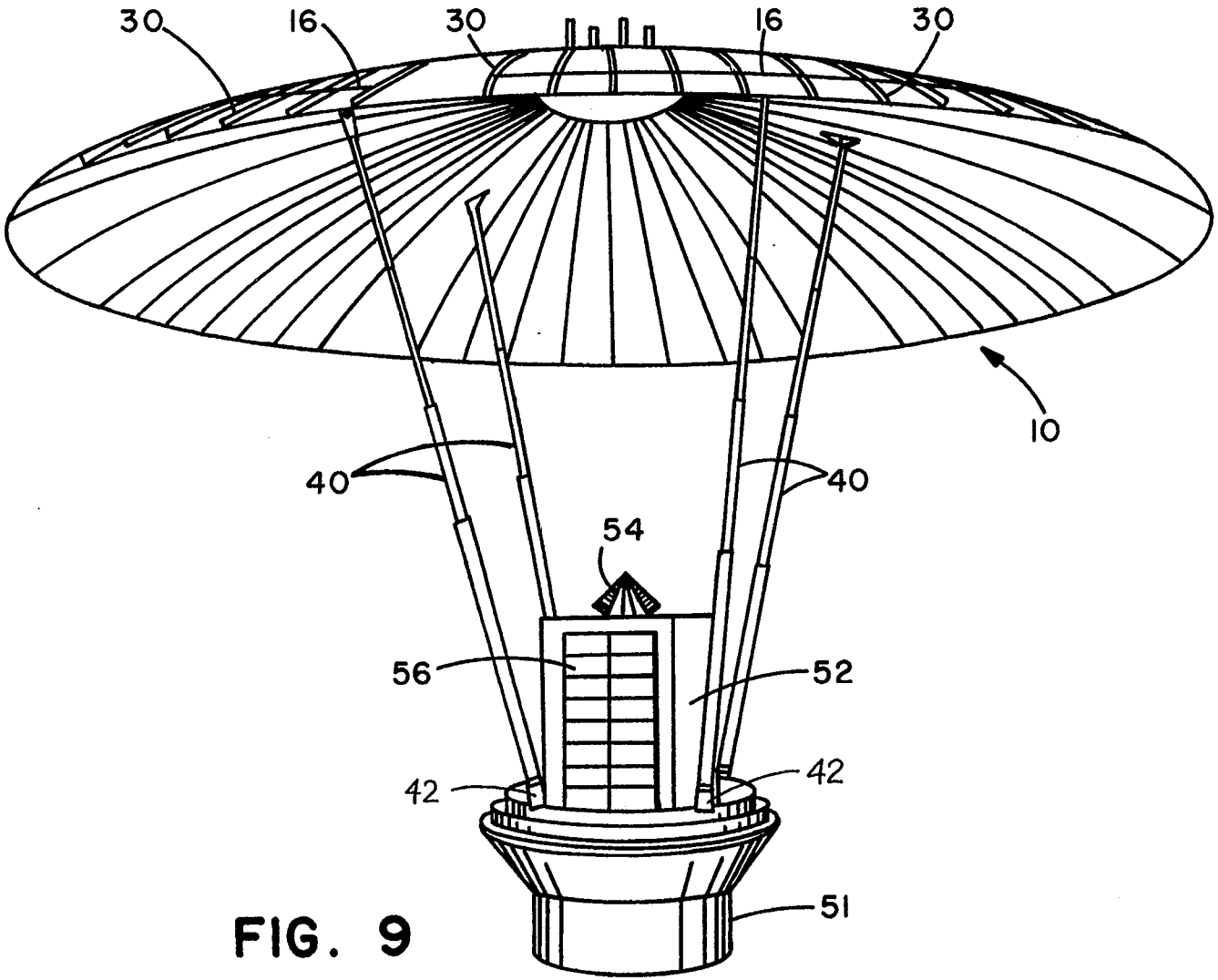
FIG. 9 is a perspective view of the embodiment of FIG. 6 in a fully deployed position.

Next, the activating means 44 attached to the attachment elements 28 are actuated, driving the center disk 26 toward the center section and to a position adjacent the top ring 22. This causes the final stage of the reflector 10 deployment that ceases when the hinged petal notches 12 lock into position against the central disk 26. A fully deployed reflector is shown in FIG. 9. At this final stage, the slightly overlapped petals 20 are restrained to the desired final reflector 10 diameter by a circumferential cable 16 on the top surface of the petals 20.

Thus deployed, the reflector surface of the deployed fanfold reflector 10 has a series of small steps formed by the slightly overlapped edges of the thin petals 20. These steps in the parabolic surface are equal to the petal thickness. In a preferred embodiment, this thickness is estimated to be on the order of five to ten thousandths of an inch for a deployed reflector diameter of 50 to 60 feet. Thus, the stepped surface closely approximates a solid parabolic surface.

An important aspect of the present inventive reflector apparatus 10 is the lack of a center post. This permits full illumination of the entire reflector surface by the feed S4. It also permits beam scan by tilting the reflector apparatus 10 about its vertex by differential extension of the telescoping strut elements 40. For each degree of reflector surface tilt, the beam scans approximately two degrees. Thus, by selectively telescoping each of the strut elements 40, the R.F. beam may be rotated a full 360 degrees about the central axis A—A. By extension of the four struts uniformly, the focal point of the reflector may be moved in the axial direction to coincide with the phase center of the feed.

In practicing the invention, the entire reflector apparatus 10, including the base 52, are detached from the launch vehicle 51 prior to deployment. Thus, the shroud 50 may be shed just prior to detachment of the reflector 10.

The foregoing description of the preferred embodiment of the invention is presented only for purposes of illustration and description. It is not intended to be exhaustive or to limit the invention to the precise form disclosed, and obviously many modifications and variations are possible in light of the above teaching. This embodiment is chosen and described in order to best explain the principles of the invention and its practical applications. It is also chosen to enable others skilled in the art to best utilize the invention in various embodiments and with various modifications as are suitable to the particular use contemplated. It is intended that the spirit and scope of the invention are to be defined by reference to the claims appended hereto.

What is claimed is:

1. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surface of adjacently disposed ones of the plurality of elongate members overlap one another along at least one edge to form a solid, continuously curved parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position.

2. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surfaces of the plurality of elongate members forms a solid parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached .to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position, wherein the struts comprise linear actuators.

3. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surfaces of the plurality of elongate members forms a solid parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position, wherein each elongate member further comprises a locking notch on said bottom surface proximate the second end of the elongate member, for locking the center disk in the deployed position.

4. The apparatus of claim 1, wherein each elongate member further comprises an elongate rib element attached to and extending along at least a portion of the top surface of the elongate members.

5. The apparatus of claim 4, wherein the rib elements are fabricated from a substantially rigid material.

6. The apparatus of claim 1, wherein each elongate member comprises flexible, shape-memory material.

7. The apparatus of claim 6, wherein the shape-memory material comprises a high modulus graphite material and resin system with shape-memory.

8. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surfaces of the plurality of elongate members forms a solid parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position, and further comprising a plurality of spaced apart structural members, each structural member being comprised of a structural elongated member having a rib element centrally positioned on a top surface thereof and extending along the length of the structural member, each of said structural members being attached to one of the struts and having a width greater than a width of the elongate members, and interspersed among the elongate members such that in the undeployed, stored position a plurality of the elongate members proximate the structural element overlap one another under the structural element.

9. The apparatus of claim 1, further comprising a hinge element connecting each elongate member to the top ring.

10. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surfaces of the plurality of elongate members forms a solid parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position, and further comprising a circumferential cable element of fixed length that extends across the top surface of each elongate member for securing a preselected spacing among the elongate member in the deployed position.

11. A deployable, steerable reflector apparatus for reflecting electromagnetic signals, comprising:

A. a plurality of elongate members each having a bottom surface for reflecting incident radiofrequency (RF) energy and a top surface opposite the bottom surface, each elongate member having a shape that tapers from a first end towards a second end and being of sufficient width such that the bottom surfaces of the plurality of elongate members forms a solid parabolic surface to incident RF energy when in a deployed position and the top surfaces of the plurality of elongate members form a conical shape when in an undeployed, stored position;

B. a top ring, to which the second end of each elongate member is attached;

C. a plurality of adjustable struts each attached at one end to said bottom surface of selected ones of the elongate members;

D. first activating means attached to the struts for lengthening the struts;

E. a center disk positioned spaced apart from the top ring and attached to the top ring by at least one elongate attachment element; and F. second activating means attached to the at least one attachment element for positioning the center disk proximate the top ring in the deployed position, and further comprising a selectively releasable lanyard element extending across the top surface of each elongate member when in the undeployed, stored position to maintain the elongate members in the stored position.

12. The apparatus of claim 1, wherein the adjustable struts are spaced apart from each other and positioned apart from a central axis of the solid, continuously curved parabolic surface.

13. A method for deploying a reflector apparatus from a first, storage position to a second, deployed position, the method comprising the steps of:

providing a deployable, steerable reflector apparatus for reflecting electromagnetic signals, the reflector apparatus comprising (a) a plurality of elongate members, each member having a bottom surface for reflecting incident radiofrequency (RF) energy and a top surface opposite the bottom surface, each elongate member further having a shape that tapers from a first end towards a second end and being of sufficient width such that the plurality of elongate members forms a solid parabolic surface to incident RF energy when in a deployed position and a conical shape when in an undeployed, stored position; (b) a top ring, to which the second end of each elongate member is attached; (c) a plurality of adjustable strut elements each attached at one end to the bottom surface of selected ones of the elongate members; (d) first activating means attached to the strut elements for lengthening the struts; (e) a center disk positioned spaced apart from the top ring and attached to the top ring by at least one elongate attachment element; and (f) second activating means attached to the attachment elements for positioning the center disk proximate the top ring in the deployed position; the method further comprising the steps of, A. activating the first activating means to telescope the strut elements to a preselected length;

B. activating the second activating means to move the center disk to a position proximate the top ring; and C. rotating the elongate members outward from the top ring.

14. The method of claim 13, wherein the apparatus further comprises a selectively releasable element extending across the top surface of each elongate member when in the undeployed, stored position to maintain the elongate members in the stored position, the method further comprising the step of releasing the elongate members from the selectively releasable element.

15. The method of claim 14, wherein the releasing step is performed after the activating of the first activating means and before the activating of the second activating means.

16. The method of claim 13, further comprising the step of, after rotating the elongate members outward, locking the center disk in a plurality of notches provided in the elongated members.

17. The method of claim 13, further comprising the step of, after rotating the elongate members, simultaneously activating at least two of the first activating means to selectively telescope at least two strut elements.

* * * * *